US010729252B1

(12) United States Patent
Chu et al.

(10) Patent No.: US 10,729,252 B1
(45) Date of Patent: Aug. 4, 2020

(54) ANGULAR POSITION ADJUSTING DEVICE FOR A CHAIR ARMREST

(71) Applicants: Zooey Chia-Tien Chu, Byron Center, MI (US); Douglas Pan, Tainan (TW)

(72) Inventors: Zooey Chia-Tien Chu, Byron Center, MI (US); Douglas Pan, Tainan (TW)

( * ) Notice: Subject to any disclaimer, the term of this patent is extended or adjusted under 35 U.S.C. 154(b) by 0 days.

(21) Appl. No.: 16/286,946

(22) Filed: Feb. 27, 2019

(51) Int. Cl.
*A47C 7/54* (2006.01)
*A47C 1/03* (2006.01)

(52) U.S. Cl.
CPC ..... *A47C 7/541* (2018.08); *A47C 1/03* (2013.01); *A47C 1/0303* (2018.08); *A47C 1/0305* (2018.08); *A47C 1/0307* (2018.08); *A47C 1/0308* (2018.08); *A47C 7/54* (2013.01)

(58) Field of Classification Search
CPC .. A47C 7/54; A47C 7/541; A47C 1/03; A47C 1/0303; A47C 1/0305; A47C 1/0307; A47C 1/0308; B60N 2/767; B64D 11/0644
USPC ..... 297/411.37, 411.38
See application file for complete search history.

(56) References Cited

U.S. PATENT DOCUMENTS 5,641,203 A * 6/1997 Van De Riet ..... A47C 1/03 297/411.37
6,017,091 A * 1/2000 Cao ..... A47C 1/03 297/411.35
6,460,932 B1 * 10/2002 Kopish ..... A47C 1/03 248/118.3
7,150,504 B1 * 12/2006 Lee ..... A47C 1/03 297/411.35
7,159,947 B1 * 1/2007 Lee ..... A47C 1/03 297/411.35
7,815,259 B2 * 10/2010 Fookes ..... A47C 1/03 297/411.35
8,235,468 B2 * 8/2012 Fookes ..... A47C 1/03 297/411.2
8,622,477 B2 * 1/2014 Colasanti ..... A47C 7/54 297/411.35
8,944,511 B2 * 2/2015 Wang ..... A47C 1/03 297/411.23
8,960,801 B2 * 2/2015 Hu ..... A47C 7/54 297/115
9,700,139 B2 * 7/2017 Su ..... A47C 1/03
10,143,310 B1 * 12/2018 Wang ..... A47C 7/541
10,537,176 B2 * 1/2020 Bock ..... A47C 1/0303
(Continued)

*Primary Examiner* — Syed A Islam
(74) *Attorney, Agent, or Firm* — Alan D. Kamrath; Mayer & Williams PC

(57) ABSTRACT

An angular position adjusting device includes a coupling column coupled with a chair body. The coupling column includes a top end having a lower coupling face with a receiving groove, a pivotal groove, and at least one restraining groove. The pivotal groove includes a bottom wall having a coupling hole. A positioning block is mounted in the receiving groove and includes a resilient portion having a positioning member. A seat includes a lower end having an upper coupling face with an axle received in the pivotal groove. A fastener extends through the axle and is coupled with the coupling hole of the coupling column. The positioning member is selectively and releasably engaged in one of angularly spaced positioning grooves of the upper coupling face. At least one restraining member is disposed on the upper coupling face and is slidably received in the at least one restraining groove.

3 Claims, 5 Drawing Sheets

(56) References Cited

U.S. PATENT DOCUMENTS

| | | | | |
|---|---|---|---|---|
| 2002/0070598 | A1* | 6/2002 | Perl | A47C 1/03 297/411.35 |
| 2007/0007810 | A1* | 1/2007 | Wu | A47C 1/03 297/411.37 |
| 2011/0248543 | A1* | 10/2011 | Hitchcock | A47C 1/03 297/411.36 |
| 2014/0145490 | A1* | 5/2014 | Chen | A47C 1/03 297/411.37 |

* cited by examiner

ANGULAR POSITION ADJUSTING DEVICE FOR A CHAIR ARMREST

BACKGROUND OF THE INVENTION

The present invention relates to an angular position adjusting device for a chair armrest and, more particularly, to a stable angular position adjusting device for a chair armrest.

Conventional chairs generally include two armrests at two sides thereof to support forearms for improving the sitting comfort. Each of the two armrests includes a coupling column and a supporting pad fixed on top of the coupling column. Each supporting pad extends in a front/rear direction. The supporting pads support the forearms of a user.

However, the user may change his or her sitting position when doing different works (such as typing) or at rest. The supporting pads fixed in a certain angular position cannot always properly support the forearms.

To improve the applicability of the armrests, a supporting pad with an adjustable angular position is proposed. A bottom of the supporting pad is pivotably coupled to a coupling column. The supporting pad can be pivoted to a desired angular position relative to the coupling column. However, when the pivotal force is large, the coupling stability is not good, such that the supporting pad cannot be stably held on the coupling column while failing to be reliably retained in position.

BRIEF SUMMARY OF THE INVENTION

An objective of the present invention is to provide a stable angular position adjusting device for a chair armrest.

An angular position adjusting device for a chair armrest according to the present invention includes a coupling column having a lower end configured to couple with a chair body. The coupling column includes a top end having a lower coupling face. The lower coupling face includes a receiving groove, a pivotal groove, and at least one restraining groove. The pivotal groove includes a bottom wall having a coupling hole. A positioning block made of an elastic material is mounted in the receiving groove and includes a resilient portion which is flexible in a vertical direction. The resilient portion includes a positioning member protruding upwards therefrom. A supporting pad includes a seat having a lower end with an upper coupling face corresponding to the lower coupling face of the coupling column. An axle is disposed on the upper coupling face, is received in the pivotal groove, and includes a coupling hole in a central portion thereof. A fastener extends through the coupling hole of the supporting pad and is coupled with the coupling hole of the coupling column. The upper coupling face further includes a plurality of positioning grooves spaced from each other in an angular direction. The positioning member is selectively and releasably engaged in one of the plurality of positioning grooves. At least one restraining member is disposed on the upper coupling face and is slidably received in the at least one restraining groove.

In an example, the pivotal groove is located behind the receiving groove of the coupling column. The at least one restraining groove includes an arcuate rear restraining groove located in front of the pivotal groove and an arcuate front restraining groove located in front of the receiving groove. The at least one restraining member includes a rear restraining member and a front restraining member. The rear restraining member is slidably received in the rear restraining groove and is located in front of the axle. The front restraining member is slidably received in the front restraining groove. The front and rear restraining members are configured to be stopped by end walls of the front and rear restraining grooves to limit a maximum pivotal angle of the supporting pad.

In an example, the supporting pad further includes an upper cover. The seat includes a through-hole through which the fastener extends. The through-hole is aligned with the coupling hole of the coupling pad. The seat further includes a plurality of pegs on an upper side thereof. The upper cover includes a plurality of peg holes in a lower side thereof. The plurality of pegs is received in the plurality of peg holes.

After assembly, the upper and lower coupling faces provide a large contact area for the supporting pad and the coupling column, providing better assembly stability. Furthermore, the axle is coupled with the pivotal groove, the front and rear restraining members are slidably received in the front and rear restraining grooves, respectively, and the positioning member in the central portion is engaged with one of the plurality of positioning grooves. Thus, the force is uniformly distributed to provide a stable assembly. The positioning block is made of a material with a better flexibility to provide better positioning stability for the positioning member and the plurality of positioning grooves. Furthermore, the front and rear restraining members are stopped by the end walls of the front and rear restraining grooves to prevent excessive pivotal movement of the supporting pad. Thus, the movement is more stable, and the service life can be prolonged.

The present invention will become clearer in light of the following detailed description of illustrative embodiments of this invention described in connection with the drawings.

DETAILED DESCRIPTION OF THE INVENTION

Figure 1:
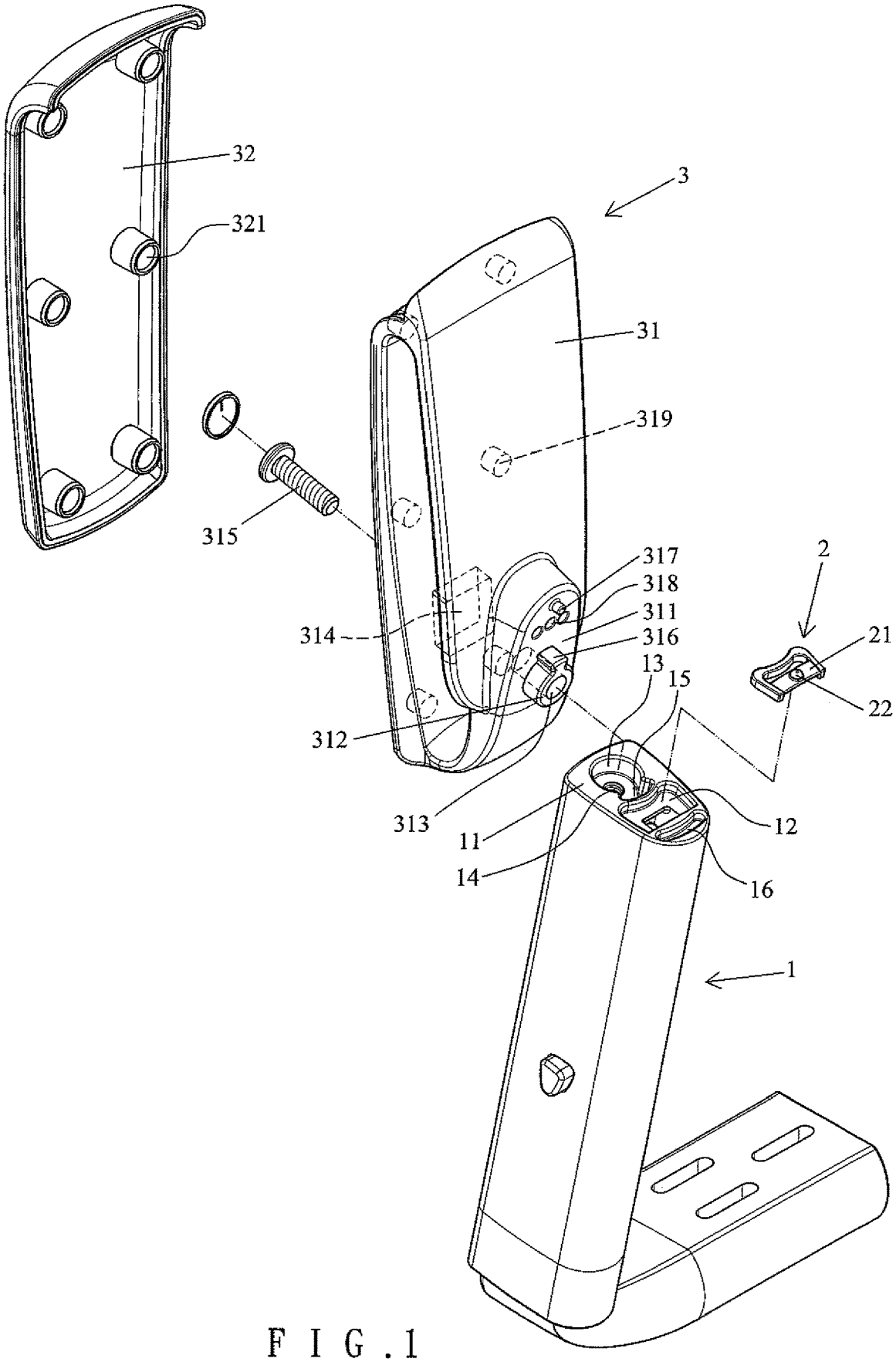
FIG. 1 is an exploded, perspective view of an angular position adjusting device for a chair armrest of an embodiment according to the present invention.
Figure 2:
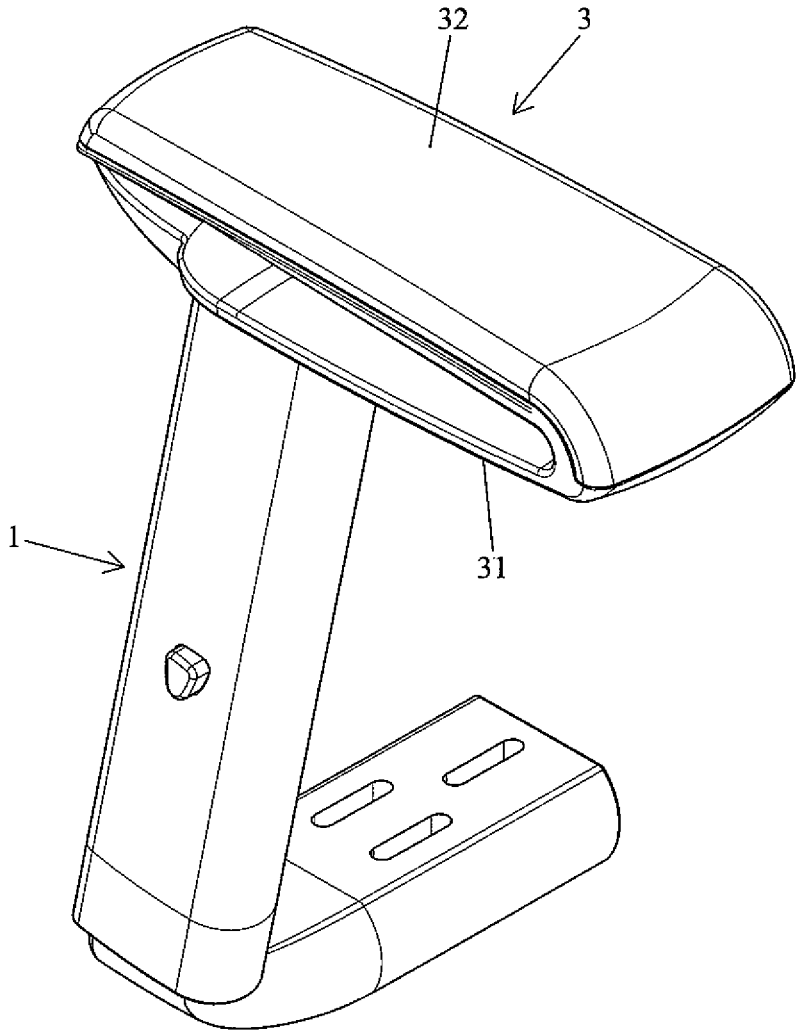
FIG. 2 is a perspective view of the angular position adjusting device of FIG. 1.

With reference to FIGS. 1-4, an angular position adjusting device for a chair armrest according to the present invention includes a coupling column 1, a positioning block 2, and a supporting pad 3. The coupling column 1 includes a lower end configured to couple with a chair body (not shown). The coupling column 1 includes a top end having a lower coupling face 11. The lower coupling face 11 includes a receiving groove 12 in a central portion thereof, a pivotal groove 13 located behind the receiving groove 12, and at least one restraining groove. The pivotal groove 13 includes a bottom wall having a coupling hole 14. In this embodiment, the at least one restraining groove includes an arcuate rear restraining groove 15 located in front of the pivotal groove 13 and an arcuate front restraining groove 16 located in front of the receiving groove 12.

The positioning block 2 is made of an elastic material and is mounted in the receiving groove 12. The positioning block 2 includes a resilient portion 21 which is flexible in a vertical direction. The resilient portion 21 includes a positioning member 22 protruding upwards therefrom.

The supporting pad 3 includes a seat 31 and an upper cover 32. The seat 31 includes a lower end having an upper coupling face 311 corresponding to the lower coupling face 11 of the coupling column 1. An axle 312 is disposed on the upper coupling face 311 and includes a coupling hole 313 in a central portion thereof. The seat 31 includes a through-hole 314 aligned with the coupling hole 313. A fastener 315 extends through the through-hole 314 and the coupling hole 313 of the supporting pad 3 and is coupled with the coupling hole 14 of the coupling column 1. At least one restraining member is disposed on the upper coupling face 311. In this embodiment, the at least one restraining member includes a rear restraining member 316 and a front restraining member 317. The rear restraining member 316 is slidably received in the rear restraining groove 15 and is located in front of the axle 312. The front restraining member 317 is slidably received in the front restraining groove 16. The front and rear restraining members 317 and 316 are configured to be stopped by end walls of the front and rear restraining grooves 16 and 15 to limit a maximum pivotal angle of the supporting pad 3. The upper coupling face 311 further includes a plurality of positioning grooves 318 spaced from each other in an angular direction. The seat 31 further includes a plurality of pegs 319 on an upper side thereof. The upper cover 32 includes a plurality of peg holes 321 in a lower side thereof. The plurality of pegs 319 is received in the plurality of peg holes 321.

In assembly, the positioning block 2 is mounted in the receiving groove 12 of the coupling column 1 with the positioning member 22 facing upwards. The seat 31 of the supporting pad 3 is detached from the upper cover 32. The lower coupling face 11 abuts the upper coupling face 311. The axle 312 is inserted into the pivotal groove 13. The front and rear restraining members 317 and 316 are placed into the front and rear restraining grooves 16 and 15, respectively. The fastener 315 extends through the through-hole 314 and the coupling hole 313 of the supporting pad 3 and is coupled with the coupling hole 14 of the coupling column 1. The positioning member 22 is engaged with one of the plurality of positioning grooves 318. The upper cover 32 is then coupled to the seat 31 by coupling the plurality of pegs 319 with the plurality of peg holes 321. The assembly can, thus, be easily achieved. The resultant armrest provides an improved sense of quality. The positioning block 2 is an independent component that is light and small to reduce the costs. Furthermore, the positioning block 2 can be made of a more elastic material less likely to break, providing a longer service life.

After assembly, the upper and lower coupling faces 311 and 11 provide a large contact area for the supporting pad 3 and the coupling column 1, providing better assembly stability. Furthermore, the axle 312 is coupled with the pivotal groove 13, the front and rear restraining members 317 and 316 are slidably received in the front and rear restraining grooves 16 and 15, respectively, and the positioning member 22 in the central portion is engaged with one of the plurality of positioning grooves 318. Thus, the force is uniformly distributed, preventing deviation of an arm resting on the supporting pad 3.

Figure 3:
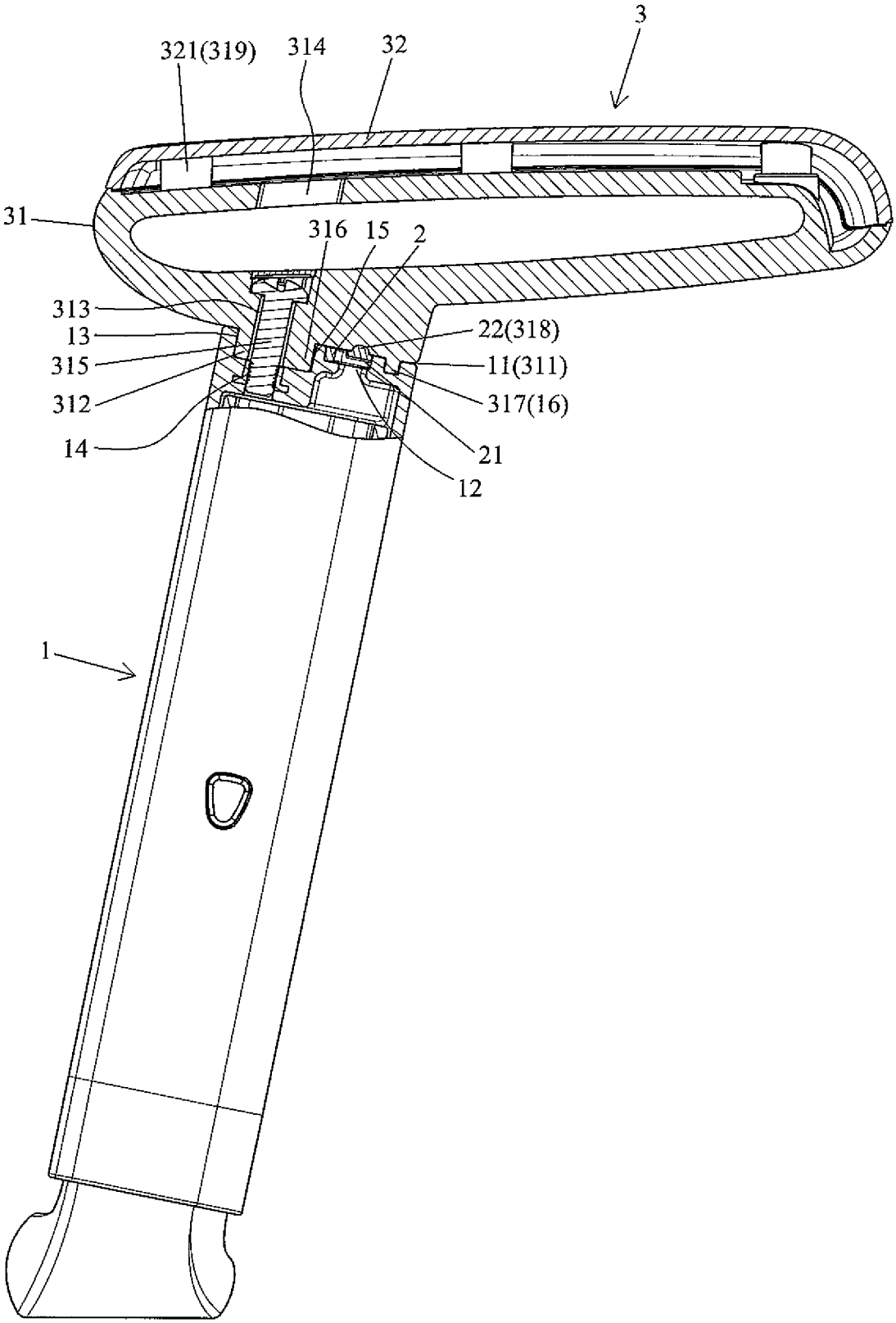
FIG. 3 is a side view, partly cross-sectioned, of the angular position adjusting device of FIG. 2.
Figure 4:
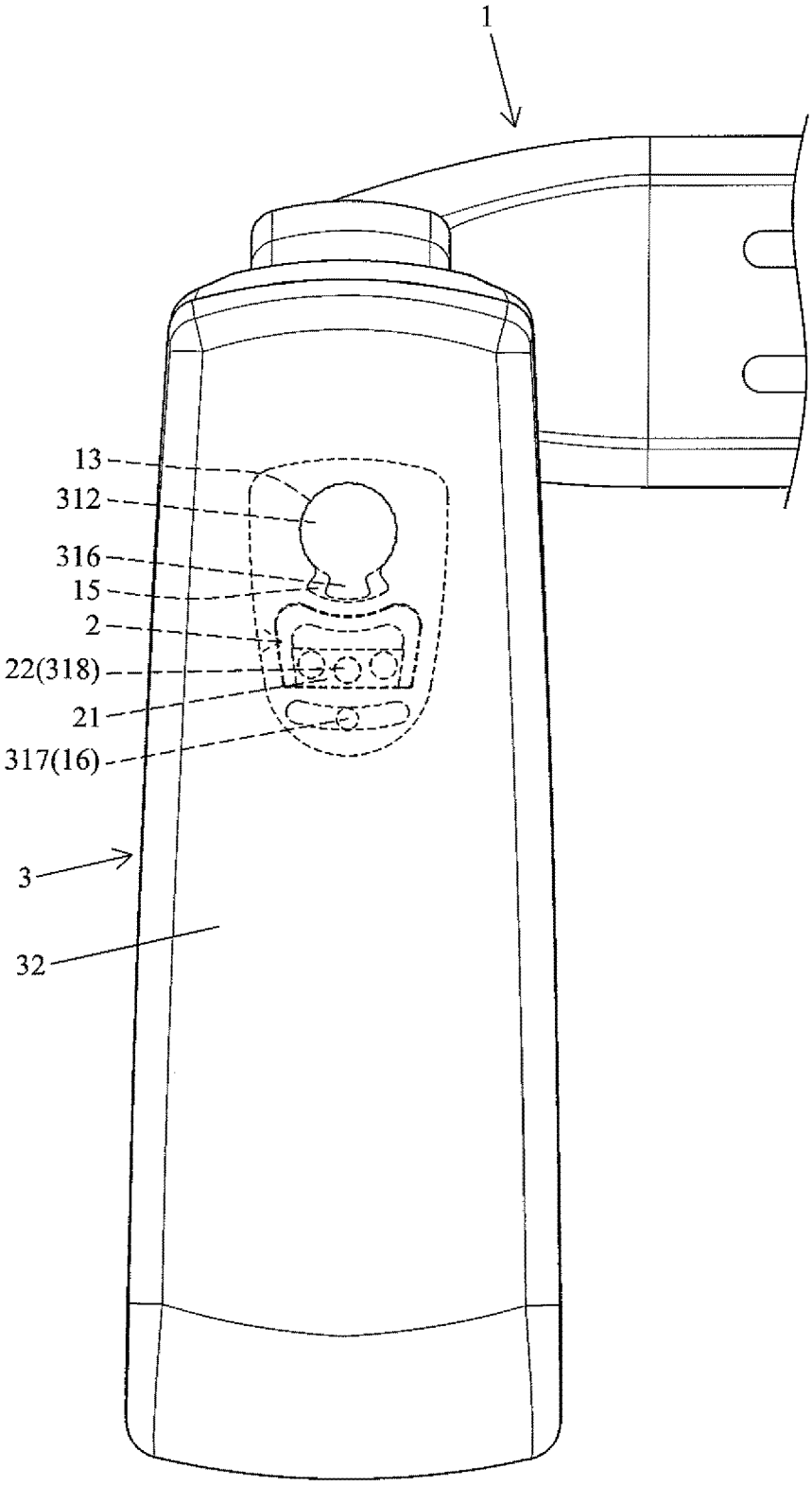
FIG. 4 is a top view of the angular position adjusting device of FIG. 2.
Figure 5:
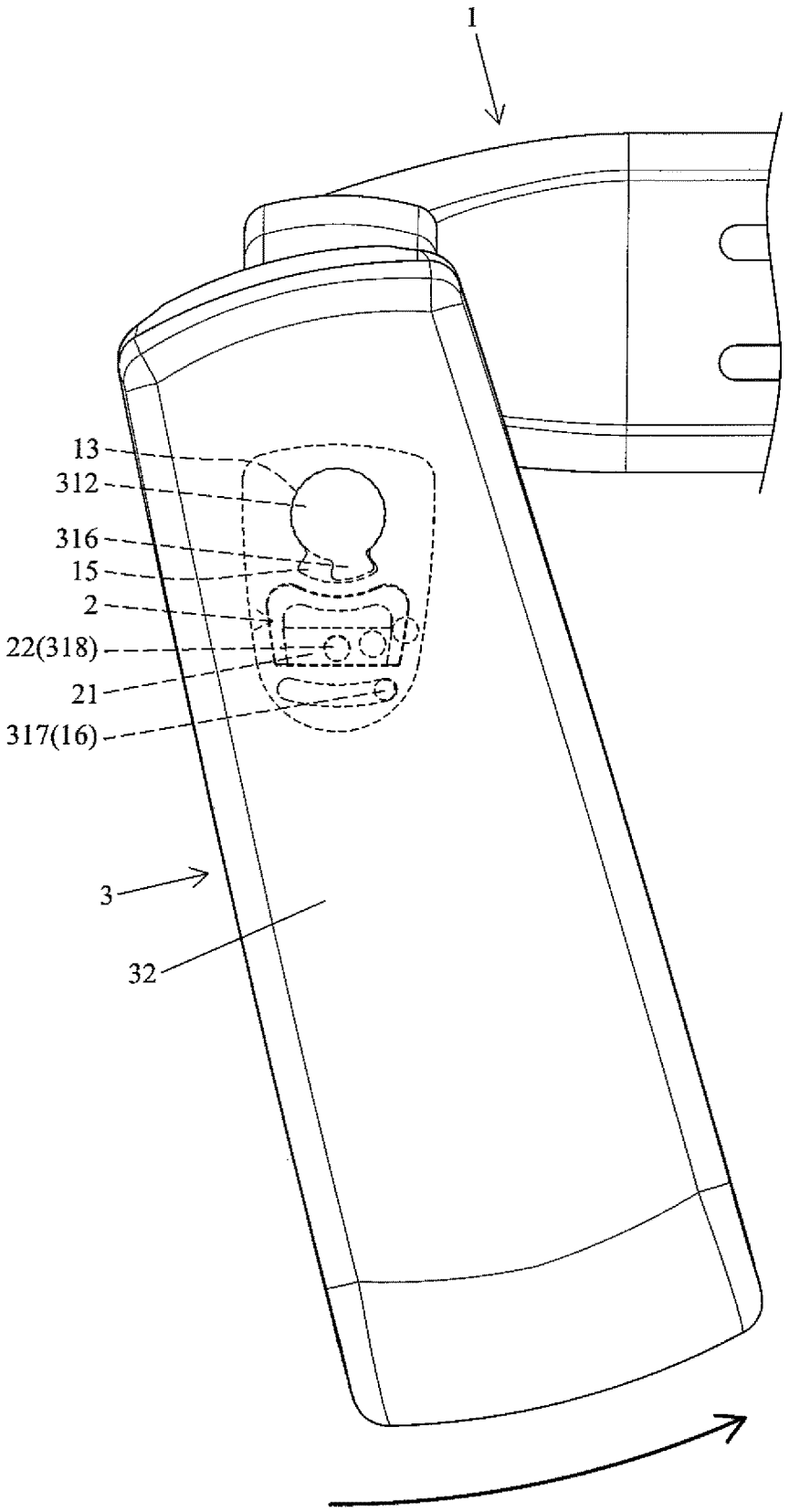
FIG. 5 is a view similar to FIG. 4, illustrating adjustment of the angular position.

With reference to FIGS. 3-5, the angular position of the supporting pad 3 according to the present invention can be adjusted according to the position of the forearm of the sitter. When the supporting pad 3 pivots relative to the coupling column 1, the resilient portion 21 of the positioning block 2 flexes vertically to permit the positioning member 22 to selectively and releasably engage with one of the plurality of positioning grooves 318 in different angular positions. Furthermore, the axle 312 pivots in the pivotal groove 13 during pivotal movement of the supporting pad 3. Furthermore, the fastener 315 enhances the strength at the pivotal location. Furthermore, the pivotal movement of the supporting pad 3 is more stable by the provision of the front and rear restraining members 317 and 316 slidably received in the front and rear restraining grooves 16 and 15, respectively.

The positioning block 2 according to the present invention is made of a material with a better flexibility to provide better positioning stability for the positioning member 22 and the plurality of positioning grooves 318. Furthermore, the front and rear restraining members 317, 316 are stopped by the end walls of the front and rear restraining grooves 16, 15 to prevent excessive pivotal movement of the supporting pad 3. Thus, the movement is more stable, and the service life can be prolonged.

In view of the foregoing, the angular position adjusting device according to the present invention provides assembly reliability and supporting and positioning stability.

Although specific embodiments have been illustrated and described, numerous modifications and variations are still possible without departing from the scope of the invention. The scope of the invention is limited by the accompanying claims.

The invention claimed is:

1. An angular position adjusting device for a chair armrest, comprising:

a coupling column including a lower end configured to couple with a chair body, wherein the coupling column includes a top end having a lower coupling face, wherein the lower coupling face includes a receiving groove, a pivotal groove, and at least one restraining groove, and wherein the pivotal groove includes a bottom wall having a coupling hole;

a positioning block made of an elastic material, wherein the positioning block is mounted in the receiving groove and includes a resilient portion which is flexible in a vertical direction, and wherein the resilient portion includes a positioning member protruding upwards therefrom; and a supporting pad including a seat having a lower end with an upper coupling face corresponding to the lower coupling face of the coupling column, wherein an axle is disposed on the upper coupling face, is received in the pivotal groove, and includes a coupling hole in a central portion thereof, wherein a fastener extends through the coupling hole of the supporting pad and is coupled with the coupling hole of the coupling column, wherein the upper coupling face further includes a plurality of positioning grooves spaced from each other in an angular direction, wherein the positioning member is selectively and releasably engaged in one of the plurality of positioning grooves, and wherein at least one restraining member is disposed on the upper coupling face and is slidably received in the at least one restraining groove.

2. The angular position adjusting device for the chair armrest as claimed in claim 1, wherein the pivotal groove is located behind the receiving groove of the coupling column, wherein the at least one restraining groove includes an arcuate rear restraining groove located in front of the pivotal groove and an arcuate front restraining groove located in front of the receiving groove, wherein the at least one restraining member includes a rear restraining member and a front restraining member, wherein the rear restraining member is slidably received in the rear restraining groove and is located in front of the axle, wherein the front restraining member is slidably received in the front restraining groove, and wherein the front and rear restraining members are configured to be stopped by end walls of the front and rear restraining grooves to limit a maximum pivotal angle of the supporting pad.

3. The angular position adjusting device for the chair armrest as claimed in claim 1, wherein the supporting pad further includes an upper cover, wherein the seat includes a through-hole through which the fastener extends, wherein the through-hole is aligned with the coupling hole of the coupling pad, wherein the seat further includes a plurality of pegs on an upper side thereof, wherein the upper cover includes a plurality of peg holes in a lower side thereof and wherein the plurality of pegs is received in the plurality of peg holes.

* * * * *